US005170162A

United States Patent [19]

Fredericks

[11] Patent Number: 5,170,162

[45] Date of Patent: Dec. 8, 1992

[54] MOTION DIRECTION DETECTION

[75] Inventor: Thomas M. Fredericks, Westbrook, Conn.

[73] Assignee: Whelen Technologies, Inc., Chester, Conn.

[21] Appl. No.: 558,455

[22] Filed: Jul. 31, 1990

Related U.S. Application Data

[63] Continuation-in-part of Ser. No. 394,636, Aug. 16, 1989, abandoned.

[51] Int. Cl.[5] ..... G08G 1/01

[52] U.S. Cl. ..... 340/935; 340/554; 342/69; 364/436

[58] Field of Search ..... 342/69; 340/935, 936, 340/942, 943, 924, 903, 928, 435, 522, 523, 554, 901; 364/436, 438

[56] References Cited

U.S. PATENT DOCUMENTS

| | | | |
|---|---|---|---|
| 3,152,315 | 10/1964 | Rodgers | 340/935 X |
| 3,680,074 | 7/1972 | Lieser | 340/584 X |
| 3,691,558 | 9/1972 | Hoard et al. | 340/554 X |
| 4,195,286 | 3/1980 | Galvin | 340/522 X |
| 4,195,289 | 3/1980 | Cole | 340/554 |
| 4,356,476 | 10/1982 | Healey et al. | 340/522 |
| 4,437,089 | 3/1984 | Achard | 340/522 X |
| 4,543,577 | 9/1985 | Tachibana et al. | 340/904 |
| 4,549,181 | 10/1985 | Tachibana et al. | 340/904 |
| 4,866,438 | 9/1989 | Knisch | 340/936 |
| 4,893,125 | 1/1990 | May | 342/69 X |

FOREIGN PATENT DOCUMENTS

| | | | |
|---|---|---|---|
| 2149991 | 6/1985 | United Kingdom | 342/69 |

*Primary Examiner*—Jin F. Ng
*Assistant Examiner*—Brent A. Swarthout
*Attorney, Agent, or Firm*—Chilton, Alix & Van Kirk

[57] ABSTRACT

The direction of motion of objects is sampled to determine, in a manner in which substantially avoids false alarms, whether there is object motion in a direction of interest. Systems employing such sampling methodology generate a warning signal in response to a vehicular traffic condition of interest and include at least a pair of motion detectors. Each motion detector processes motion information bearing signals to determine distance traveled in a predetermined time period to minimize false alarms.

25 Claims, 8 Drawing Sheets

PHASE O & PHASE I ARE DIRECTLY PROPORTIONAL TO SPEED

MOTION DIRECTION DETECTION

CROSS-REFERENCE TO RELATED APPLICATION

The present application is a continuation-in-part of abandoned Application Ser. No. 394,636 filed Aug. 16, 1989.

BACKGROUND OF THE INVENTION

1. Field of the Invention

The present invention relates to the unambiguous detection of the presence of an object moving along a predetermined route and the determination of the direction of movement of such object. More specifically, this invention is directed to motion detection systems which discriminate between continuous motion of an object in a first direction and any other direction of movement of such object, the systems providing a warning signal commensurate with object motion in the first direction, and especially to systems of such character for energizing an alarm upon the unambiguous detection of vehicular traffic moving in a direction of interest. Accordingly, the general objects of the present invention are to provide novel and improved methods and apparatus of such character.

2. Description of the Prior Art

While not limited thereto in its utility, the present invention is particularly useful in the field of highway safety to provide a warning that a vehicle is entering a roadway traveling in a direction opposite to the normal traffic flow. There is a need, long unfulfilled, for a way of alerting motorists to the fact that they are about to enter a roadway traveling in the wrong direction and there is a concomitant longstanding need for means for alerting safety authorities and/or other motorists of the presence of a wrong-way vehicle. Obviously, the techniques and hardware for providing such warnings have applicability to other fields such as, for example, security systems.

Apparatus and techniques for detecting object motion and determining the direction of such motion are known in the art. Such known systems employ a source of radiant energy, i.e., ultrasound, light or microwave, and have found application in fields such as traffic light control and door openers. However, the previously known apparatus has not been suitable for the more demanding application, briefly discussed above, which the present invention is initially intended to serve. For use in the field of highway safety, it is exceedingly important that the alarm condition not be activated in response to false sensing, for example due to stray reflections of the radiant energy or movement of an animal. It is also desirable to be able to determine whether the vehicle operator has reacted to an activated "wrong way" alarm and has either ceased traveling in the improper direction or is, at least, decreasing the rate of travel in the wrong direction. Similarly, in order to be suitable for any traffic control purpose, a motion detection and discrimination system and technique must be highly reliable, have self-checking capability, be characterized by redundant testing for the occurrence of the alarm condition and have only modest power supply requirements. These characteristics are not critical in applications such as simple traffic light control and door openers and thus have not previously been available.

SUMMARY OF THE INVENTION

The present invention supplies the above-discussed needs and, in so doing, provides a technique and system having all of the above-discussed attributes dictated by the expected vehicle traffic control environment.

In accordance with a first embodiment of the invention, a region which includes a portion of a path of expected object, i.e., vehicle, motion is monitored through the use of a first motion detector. The motion detector will include a radiant energy source and, typically, will operate on the Doppler principle. The first motion detector will provide output signals commensurate with the motion of an object along the path portion which is in its field of view. The output signals of the first motion detector are processed to unambiguously determine the direction of object motion. When a moving object is detected, a second motion detector will be energized and will look for motion of the object in a second region along the path. If the second motion detector provides output signals commensurate with object motion, those signals will be processed to again unambiguously determine the direction of object motion. In the environment of an exit ramp wrong way traffic warning system, the object motion direction information determined from the output signals of the first and second motion detectors will then be compared and, if this information does not agree, a third motion detector will be energized to look for motion of the object in a third region along the path. Output signals provided by the third motion detector, if energized, will be analyzed to determine the direction of motion of the object. When the motion information derived from the output signals of any two motion detectors are found to be in agreement and to indicate that there is an object moving along the path in a direction which is opposite to normal direction of movement, a fourth motion detector will be energized. The field of view of the fourth motion detector along the path is downstream, in the "wrong" way direction, from the region monitored by the third motion detector. If an analysis of the output signals from the fourth motion detector indicates object motion in the wrong direction, an alarm condition signal will be produced or reinforced.

In accordance with other implementations of the present invention, only the first and second motion detectors of the first embodiment are employed. As in the above described embodiment, the two motion detectors "look" in opposite directions and are normally in the "on" condition, i.e., the detectors alternately scan a field to determine the presence of a moving object therein. Each detector is capable of determining the speed and direction of an object which appears in its field of view. The detection of object motion in a direction other than the direction of interest will result in system shut-down for a limited period time in order to minimize the possibility of false triggering because of, for example, reflections of transmitted energy from multiple objects.

Also in accordance with the present invention, the processing of the signals from the motion detectors to determine the direction of object motion is done in a manner which virtually eliminates the possibility of an incorrect determination of object direction. Thus, in the disclosed embodiments, the motion detectors provide a pair of phase-related signals, i.e., signals having a known phase difference when a stationary object is in the field of detector view. The phase of these signals is compared to determine if there is any shifting of the phase difference and, if so, the direction of such phase shift. The direction of phase shift will be indicative of whether a moving object is approaching or moving away from the motion detector. When a moving object is detected, its travel distance is monitored and compared with a predetermined minimum distance. An alarm condition signal will be generated if the distance traveled by the object exceeds a predetermined minimum distance during the monitoring period.

The processing of the output signals provided by a motion detector in accordance with the present invention may comprise one or all of a duty cycle check, frequency check and a speed determination, the generation of an alarm condition signal being enabled only if the duty cycle and frequency fall within a predetermined range and the object speed is greater than a preselected minimum speed.

BRIEF DESCRIPTION OF THE DRAWINGS

The present invention may be better understood and its numerous objects and advantages will become apparent to those skilled in the art by reference to, the accompanying drawings wherein like reference numerals refer to like elements in the several figures and in which:

FIGS. 3-1 and 3-2 comprise a schematic flow chart which depicts the data processing methodology of the system of FIG. 1;

FIGS. 4-1 and 4-2 comprise a flow chart depicting the processing of data to derive motion direction information in accordance with the methodology of FIG. 3;

DESCRIPTION OF THE DISCLOSED EMBODIMENT

Figure 1:
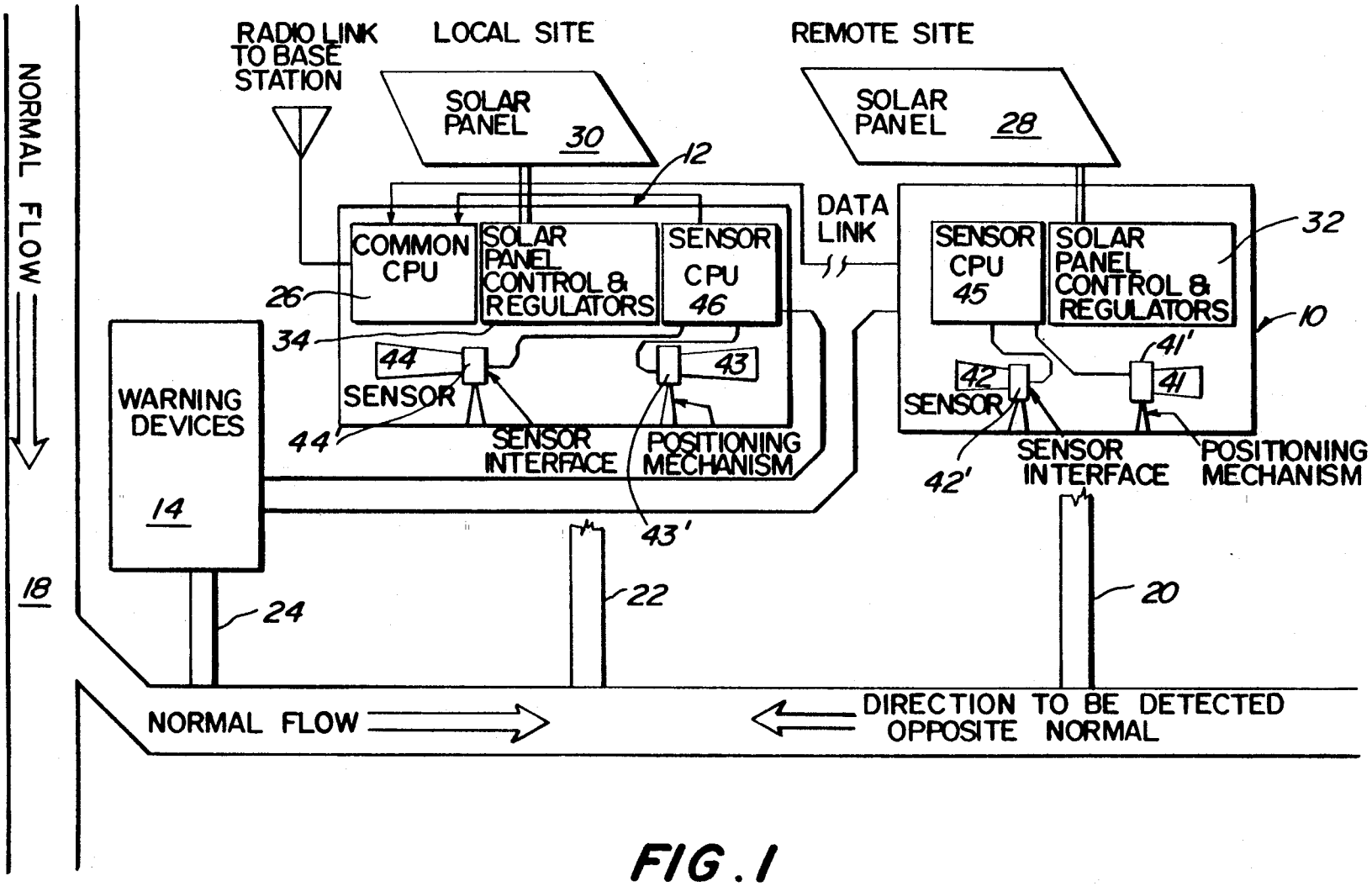
FIG. 1 is a block diagram of apparatus in accordance with a preferred embodiment of the invention.

With reference now to FIGS. 1-5 of the drawing, a warning system in accordance with a first embodiment of the present invention is shown in block diagram form in FIG. 1. The system generally comprises a pair of motion detection modules 10 and 12, a warning device or devices 14 and means for establishing communication with a base station and/or other distantly located warning devices. The modules 10 and 12 and warning devices 14 are mounted at spatially displaced locations along a roadway which, for example, may be an exit ramp 16 of a limited access highway 18. This spatially displaced mounting is schematically represented in FIG. 1 as being on poles 20, 22 and 24. The communication establishing means, in the disclosed embodiment, may be a radio link which includes a communications CPU 26. In the disclosed embodiment the computer 26 is, for convenience, commonly housed with detection module 12. Each of modules 10 and 12 is battery powered and the modules 10 and 12 respectively have associated therewith solar panels 28 and 30 which provide power for recharging the batteries. The modules also each include conventional solid state controls and voltage regulators for the solar panels and rechargeable batteries, the control/regulator packages being respectively indicated at 32 and 3 for modules 10 and 12. For the reasons which will become apparent from the discussion below, the spacing between module 12 and the warning devices 14 will be selected such that a sensor in this module will receive energy reflected from a target which has moved past, in the abnormal direction, the warning devices.

Each of the detection modules 10 and 12 includes a pair of radiant energy transceivers, hereinafter referred to as sensors, a sensor CPU and electronics for interfacing the sensors to the CPU. Thus, considering module 10, a pair of oppositely directed sensor/transceivers 41 and 42, with associated interface electronics 41' and 42', are coupled to a CPU 45. Similarly, module 12 includes a pair of oppositely directed sensor/transceivers 43 and 44, with associated interface electronics 43' and 44', and a CPU 46. In one reduction to practice of the invention, the sensors 41-44 were commercially available microwave transceivers which function as pulsed mode Doppler radar. Such radar may, for example, employ a Gunn diode mounted in a wave guide cavity to act as the transmitter and local oscillator and Schottky barrier mixer diodes which function as receivers for reflected microwave energy. Such Gunn diode Doppler radar is, for example, available from Alpha Industries, Inc. of Woburn, Mass. In such radar, the receiver mixer diodes are located one-quarter wavelength apart at the transmitter frequency so that the Doppler outputs have a 90° phase shift. Thus, the mixers have peak Doppler amplitudes that lag each other and, if a target moves toward the sensor, a peak output signal from one of the mixer diodes occurs when the output of the other mixer diode is at a null. As will be discussed below, and as may be seen from FIG. 5, these phase relationships are used to determine target direction and distance traveled.

Figure 2:
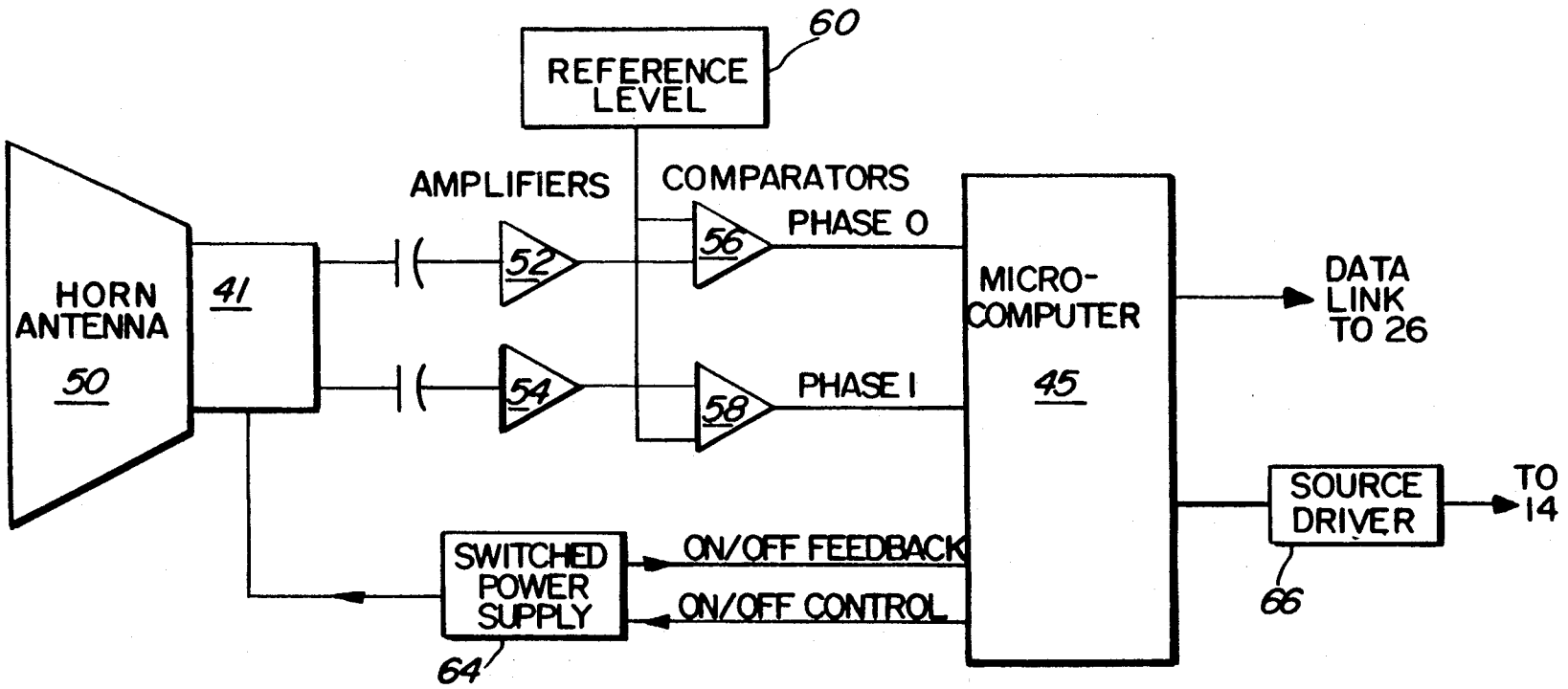
FIG. 2 is a block diagram of a portion of one of the sensor modules which comprise the system of FIG. 1.

Referring to FIG. 2, one of the microwave transceiver/sensors and its associated interface which may be used in the system of FIG. 1 is depicted in block diagram form. The Doppler radar 41 is coupled to a horn antenna 50. As noted above, the transceiver 41 provides a pair of 90° out-of-phase output signals which are respectively capacitively coupled to IF amplifiers 52 and 54. The output signals provided by the amplifiers 52 and 54 are respectively applied as first inputs to comparators 56 and 58. The second input to each of comparators 56 and 58 is provided by a reference signal source 60. The output of comparator 56 will comprise a square wave signal, hereinafter referred to as the Phase 0 signal, having a frequency which is commensurate with target speed. Similarly, the output of comparator 58 will comprise a square wave of the same frequency, hereinafter the Phase 1 signal. The outputs of the comparators are delivered to a microprocessor which functions as the sensor CPU 45. The microprocessor 45 controls a switched power supply 64 so as to cause the periodic energization of the associated sensor. The microprocessor also receives, as input information, a feedback signal from a voltage level sensor in power supply 64. The feedback signal will provide the microprocessor with a power supply status signal, i.e., an "on" or "off", and thus the microprocessor will know whether the sensor is being energized and whether the power supply has failed and, if failure has occurred, the failure mode.

The microprocessor in each of modules 10 and 12 processes the data provided by the pair of sensors in the module and their associated switched power supplies.

The output signals from the microprocessors are employed to energize, via suitable actuators such as driver 66, the warning device(s) 14. Both microprocessors, i.e., the CPU's 45 and 46, are also coupled to the communications CPU 26 to control the transmission of data to a base station. Since the system of FIG. 1 is intended to operate without connection to an external power source, power consumption is kept to a minimum. The sensors are the components of the system which consume the greatest power during normal operation. Thus, as indicated in the discussion of FIG. 2, a switched power supply is employed for each sensor. The transceivers 41 and 42 are normally on approximately 25% of the time. However, if the output of either of sensors 41 or 42 is commensurate with the motion of an object, the on-time of the sensors is extended by means of a control signal from the microprocessor 45 until a determination of signal validity has been made.

Figures 1, 3:
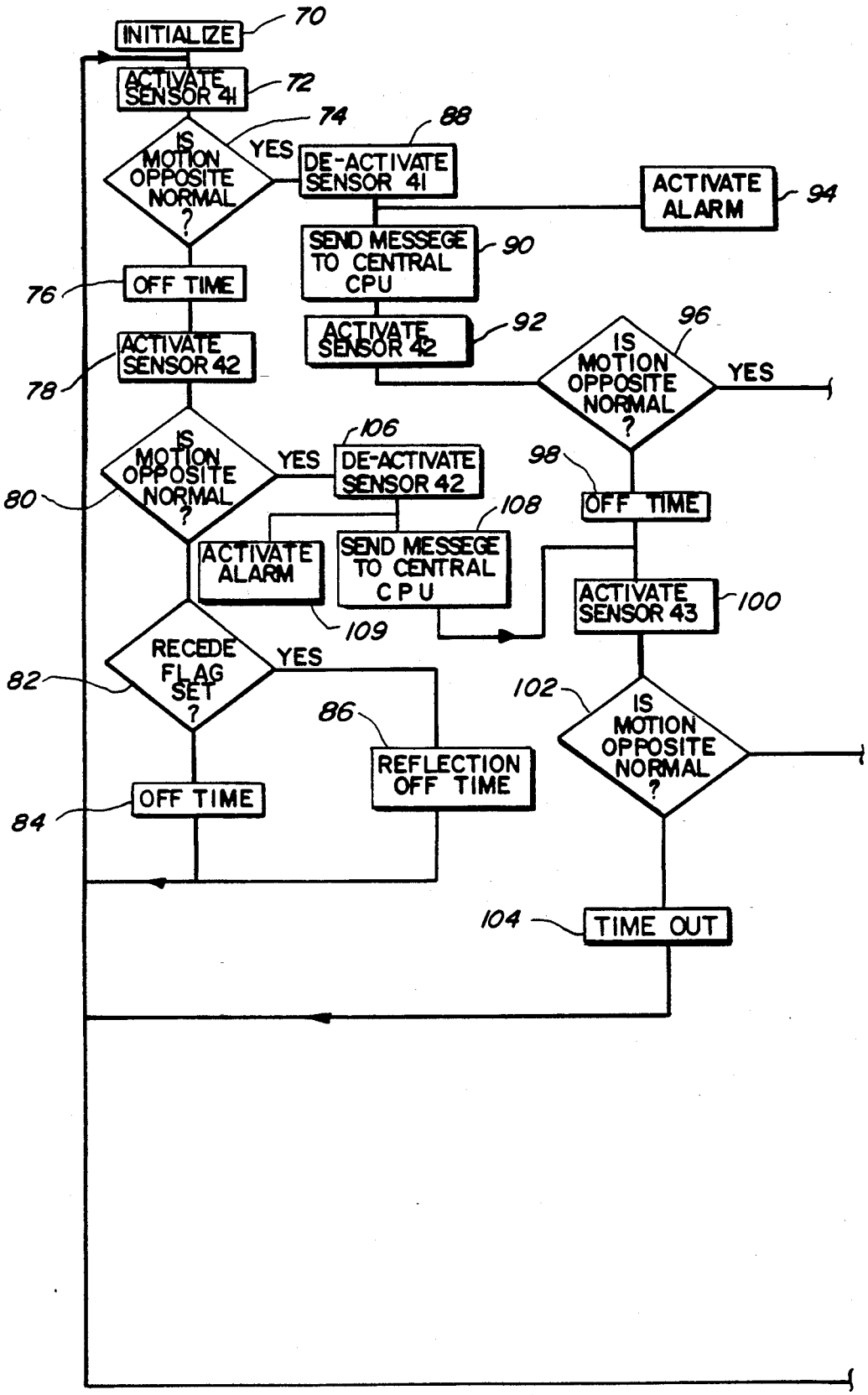
Figures 2, 3:
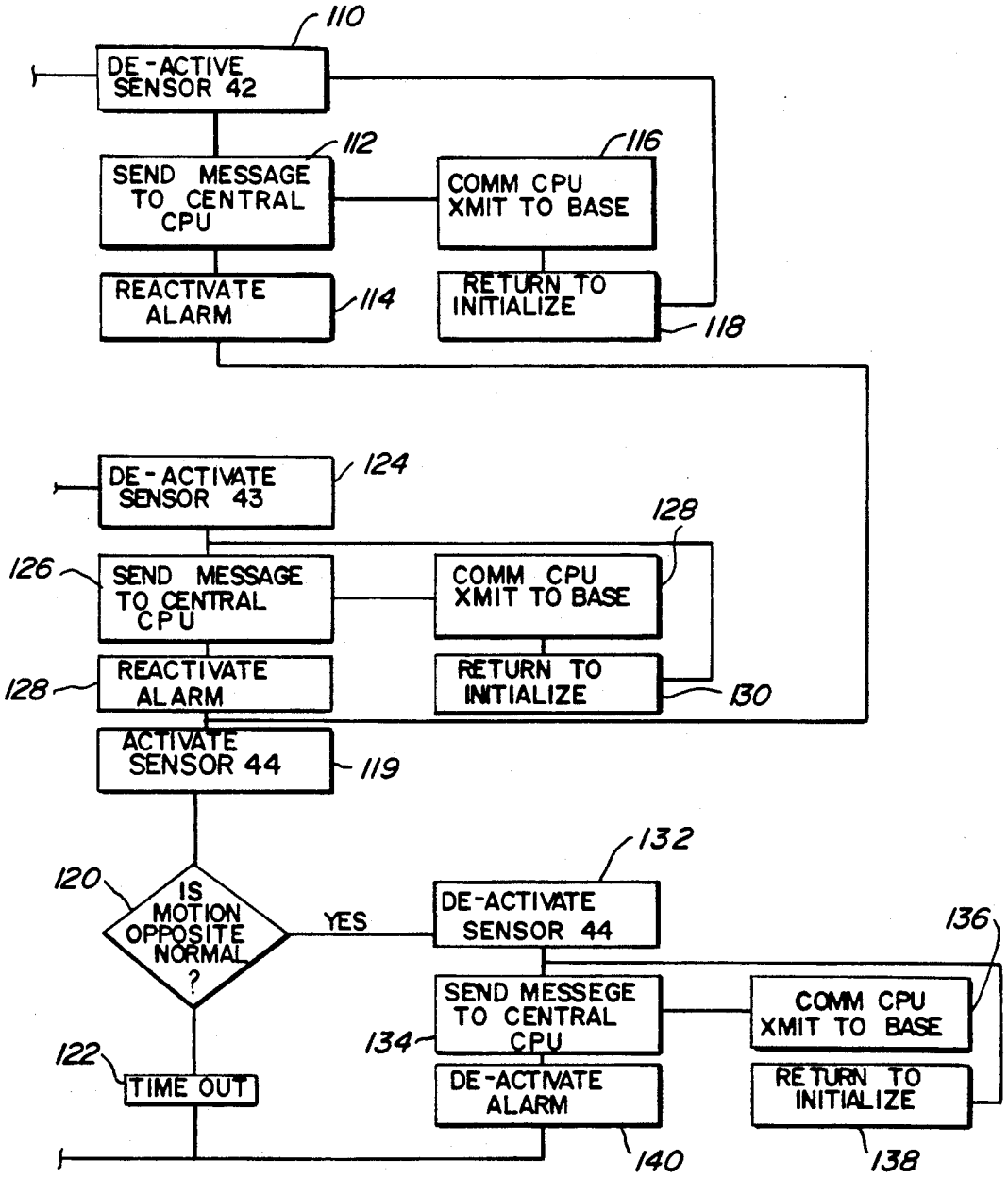

The operation of the system of FIG. 1 will now be described by reference simultaneously to FIGS. 3 through 5. During the course of normal operation, i.e., all traffic passing along the exit ramp 16 is flowing in the normal direction, and presuming the system has been initialized by the application of power as indicated by step 70 in FIG. 3, sensor 41 will be periodically activated for predetermined periods of time by CPU 45 via switched power supply 64 in accordance with the selected transceiver on time (step 72). In step 74, and as will be described in detail below in the discussion of FIG. 4, signals commensurate with energy reflected from an object in the field of sensor 41 are processed in CPU 45 to determine whether the sensed object is moving in a direction which is opposite to normal. If an object is not detected during a certain period of time, or if the detected motion is in the normal travel direction, sensor 41 will be turned off and sensor 42 activated by CPU 45 (steps 76 and 78). Sensor 42, as described above and as may be seen from FIG. 1, "looks" in the opposite direction with respect to sensor 41. Signals commensurate with energy reflected to sensor 42 are processed, as indicated by step 80, in substantially the same manner as the signals from sensor 41 are processed in step 74. If this processing indicates that there is object motion but in the normal direction of travel, a "recede" flag will be set in the manner to be described in the discussion of FIG. 4. A test will be conducted to see if the recede flag has been set as indicated by step 82. If the flag is not set, indicating either that no object has been detected or that the reflections are from a stationary object, sensor 42 will be turned off for a predetermined time (typically 75% of the cycle time), as indicated by step 84, and the cycle will start over again with the activation of sensor 41. However, if the flag is set in step 82, indicative of motion in the normal direction, the time delay before reactivation of sensor 41 will be adjusted, as indicated in step 86, as a function of the speed of the object which is determined in the manner to be described below in the discussion of FIG. 4. This adjustment of the off time is done to prevent false sensing due to stray reflections.

It should be noted that, during normal operation, the communications CPU 26 will typically be constantly monitoring a radio link with a base station and the data links to the sensor CPU's 46 and 46 in order to receive commands or to transmit information, equipment status information for example, back to the base station.

Considering now the operation of the system under alarm conditions, if the processing of data in step 74 indicates object motion in the field of sensor 41 in a direction opposite to normal, as soon as the appropriate detection parameters are met as will be discussed in the description of FIG. 4, sensor 41 is turned off as indicated by step 88. Upon the deactivation of sensor 41 commensurate with detection of an alarm condition, an alarm state "1" message is sent to the communications CPU 26 (step 90) to "arm" CPU 26, sensor 42 is turned on (step 92) and the warning devices 14 are energized (step 94). Signals commensurate with energy reflected back to sensor 42 will then be processed, in step 96, in the same manner as performed in step 74, to confirm that there is in fact object motion in the opposite to normal direction. If the information processing in step 96 does not confirm the result of processing step 74 within a predetermined time, sensor 42 will be turned off (step 98) and sensor 43 will be activated (step 100).

Upon activation of sensor 43, signals commensurate with energy reflected thereto will be processed in step 102 in the same manner information has been processed in steps 74, 80 and 96. If the processing of information in step 102 confirms the results of the processing in step 96, it is concluded that the processing of information commensurate with signals provided by sensor 41 has resulted in a false alarm and, as indicated at step 104, the arming of the communications CPU 26 is discontinued, the warning devices 14 are deenergized and the system is returned to normal operation with the reactivation of sensor 41.

If the data processing in step 80 indicates object motion opposite to normal, there thus being an inconsistency between the results of the processing of the signals provided by sensors 41 and 42, sensor 42 will be deactivated in step 106, an alarm state message will be sent to communications CPU 26 to arm this CPU (step 108), the warning devices 14 will be energized (step 109) and sensor 43 will be activated (step 100). Upon activation of sensor 43, the data processing step 102 will be performed as discussed above.

If the data processing performed in step 96 confirms the results of step 74, i.e., both of the sensors 41 and 42 have detected motion in a direction opposite to normal, sensor 42 will be deactivated in step 110 and an alarm state "2" message will be sent to communications CPU 26 in step 112 and the alarms 14 will be maintained in the activated state (step 114). In response to the receipt of an alarm state "2" message following an alarm state "1" message, as indicated by step 116, the CPU 26 will send an initial transmission to the base station indicating that motion in the wrong direction has been detected and that the warning devices have been energized. This message will also include data commensurate with the speed of the object and the identify of CPU 26 which determines its geographic location. Subsequently, after a predetermined delay, CPU 45 will be returned to the initialized state in step 118. This returning of CPU 45 to the initialized state will not remove the alarm state signals from CPU 26 and will not deenergize the warning devices 14.

Simultaneously with sending the alarm state "2" message to CPU 26 in step 112, sensor 44 will be activated in step 119. Upon activation of sensor 44, signals commensurate with energy reflected thereto will be processed in step 120, again in the same manner as data is processed in steps 74, 80, 96 and 102. If the data processing in step 120 fails to confirm the results of processing step 96 within a predetermined period of time, as indicated at step 122, the system will be returned to its initialized state and the warning devices 14 will be deenergized. When data processing step 120 fails to confirm a previous conclusion that there is object motion in a direction opposite to normal, this will typically be an indication that the wrong away object detected by another sensor or sensors in the system has heeded the warning devices 14 and has stopped.

In the case where processing step 102 confirms the conclusion of motion in a direction opposite to normal from processing step 80, sensor 43 is deactivated (step 124), an alarm state "2" message is sent to location CPU 26 (step 126) and the warning devices 14 are kept energized (step 128). As in the case of step 116, upon receipt of an alarm state "2" to message from sensor CPU 46, as indicated in step 128, CPU 26 will cause an initial message to be transmitted the base station containing the same information as discussed above with respect to step 116. Simultaneously, in step 130, the sensor CPU 46 will be returned to its initialized state. Also upon generation of the alarm state "2" message in step 126, responsive to the results of data processing step 102, sensor 44 will be activated (step 119) and processing step 120 will be performed.

If the step 120 processing of the signals commensurate with energy reflected to sensor 44 indicates motion in a direction opposite to normal, sensor 44 will be deactivated (step 132).

Simultaneously with deactivation of sensor 44, an alarm state "3" message will be sent to communications CPU 26 (step 134) and CPU 26 will command the transmission of a message to the base station which contains the information discussed above with relation to step 114 (step 136). Upon receipt of the second message commensurate with an alarm state, the base station computer will determine, from the transmitted speed information, whether the speed of the object is increasing or decreasing. Simultaneously with the sending of the alarm state "3" message to CPU 26, i.e., upon deactivation of sensor 44 in step 132, the sensor CPU 46 will be returned to its initialized state (step 138). Subsequently, after a predetermined time delay, and as indicated in step 140, the warning devices 14 will be deenergized and the system returned to normal operation.

To summarize the above, when either of sensors 41 or 42 detects a moving object, the on time of the sensor is increased. If the detected motion is opposite to the normal flow direction, the warning devices 14 are energized. However, when sensor 42 detects an object moving in the normal flow direction, both of sensors 41 and 42 are disabled for a period of time dependent upon the speed of the object. The manner in which the speed of the object is determined, and the reflection off-time computed, will be described below in the discussion of FIGS. 4 and 5. During normal operation, i.e., an object traveling in the opposite to normal direction has not been detected, sensors 43 and 44 are inactive. Under alarm conditions, through the activation of the warning devices 14, the present invention should cause an object traveling in opposite to the normal direction to stop and reverse direction. If the object stops quickly the processing of the information commensurate with the signals provided by sensor 43 or sensor 44 will not satisfy the appropriate detection parameters and after a certain period of time the warning devices 14 will be turned off and normal operation will resume with sensors 41 and 42 cycling. If the object meets the appropriate sensor 43 or sensor 44 detection parameters prior to stopping, the warning devices 14 will remain energized for a period of time before normal operation is resumed. The communications computer 26 transmits an initial message to the base station, step 116 or step 128, indicating that an object traveling opposite to the normal direction has been detected. If the object traveling in the opposite to normal direction is acquired by sensor 44, indicating that the object has passed the warning devices 14, a second message will be transmitted to the base station.

As will be obvious from the above discussion, the present invention is characterized by redundancy which minimizes the possibility of missing an object traveling opposite to the normal flow direction and also minimizes the possibility of false alarms. Thus, while the warning devices are energized if motion opposite to the normal direction is indicated by the processing of the information containing signals from either of sensors 41 or 42, an alarm message is not transmitted to the base station until the signals derived from processing the outputs of two sensors meet the appropriate detection parameters. Thus, in the event sensor 41 fails, sensor 43 will confirm the findings of sensor 42. If the processing of the sensor 41 data in step 74 results in a false alarm, redundant verification is performed by sensor 42. Likewise, if sensor 42 fails, and data processing step 74 has indicated motion opposite to normal, a redundant test will be performed in step 102. However, if processing step 80 has resulted in a false alarm, a redundant test will be performed on the output of sensor 43 in step 102. Thus, to summarize, an initial transmission to the base station indicative of object motion opposite to the normal direction will occur when the processing of the information contained in the signals provided by the following combinations of sensors is indicative of such motion opposite to normal:

Sensor 41 and Sensor 42
Sensor 41 and Sensor 43
Sensor 42 and Sensor 43

Since the conditions to which the present invention is responsive occur over a very short period of time, the initial transmission to the base station will in actual practice serve primarily as an alert. A second transmission to the base station, indicative that wrong way traffic has passed the warning device(s) 14, will occur only when the above redundant sensor conditions have been satisfied and, in addition, the processing in step 120 of the information contained in the output signals from sensor 44 indicates travel in the opposite to normal direction.

Figures 1, 4:
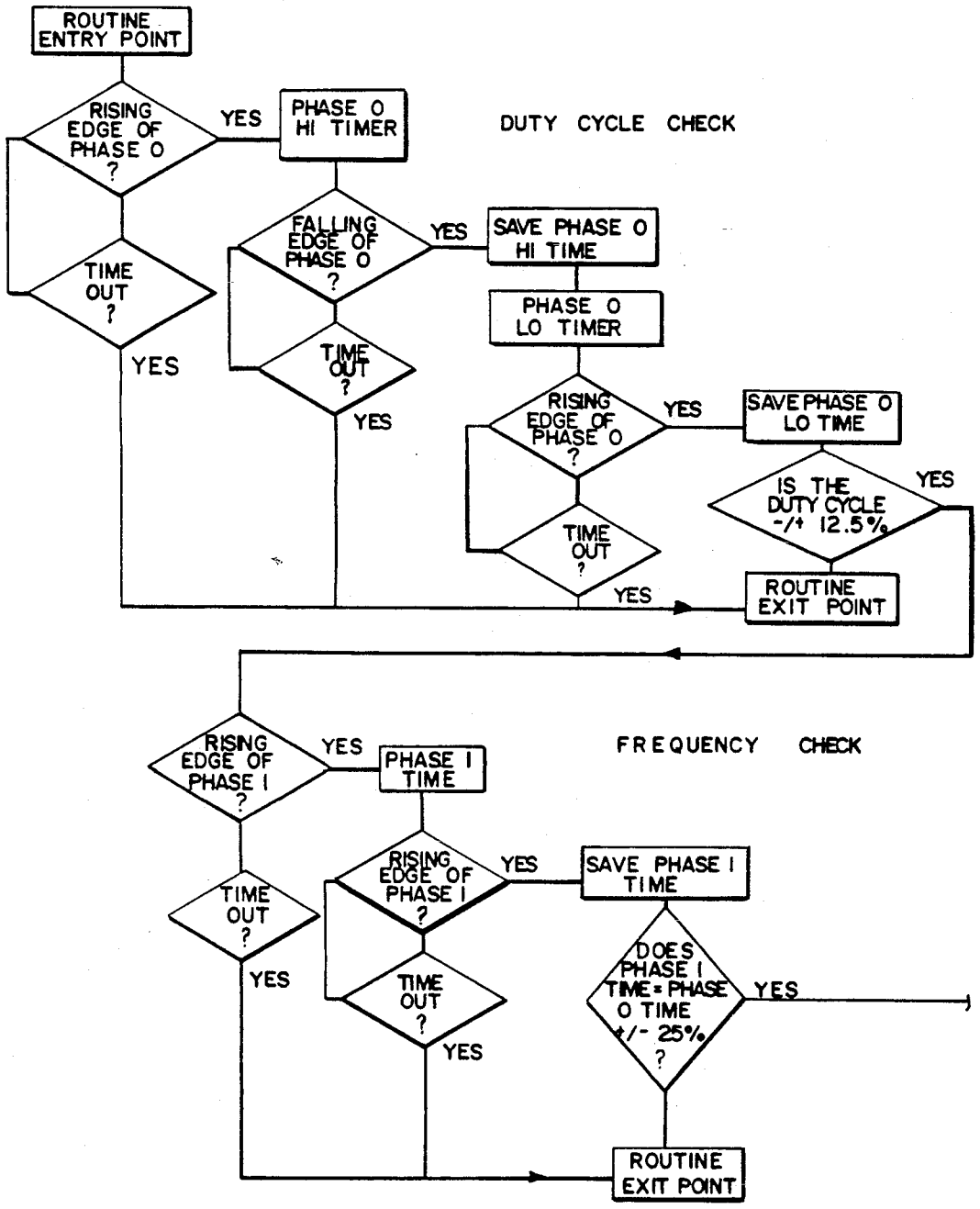
Figures 2, 4:
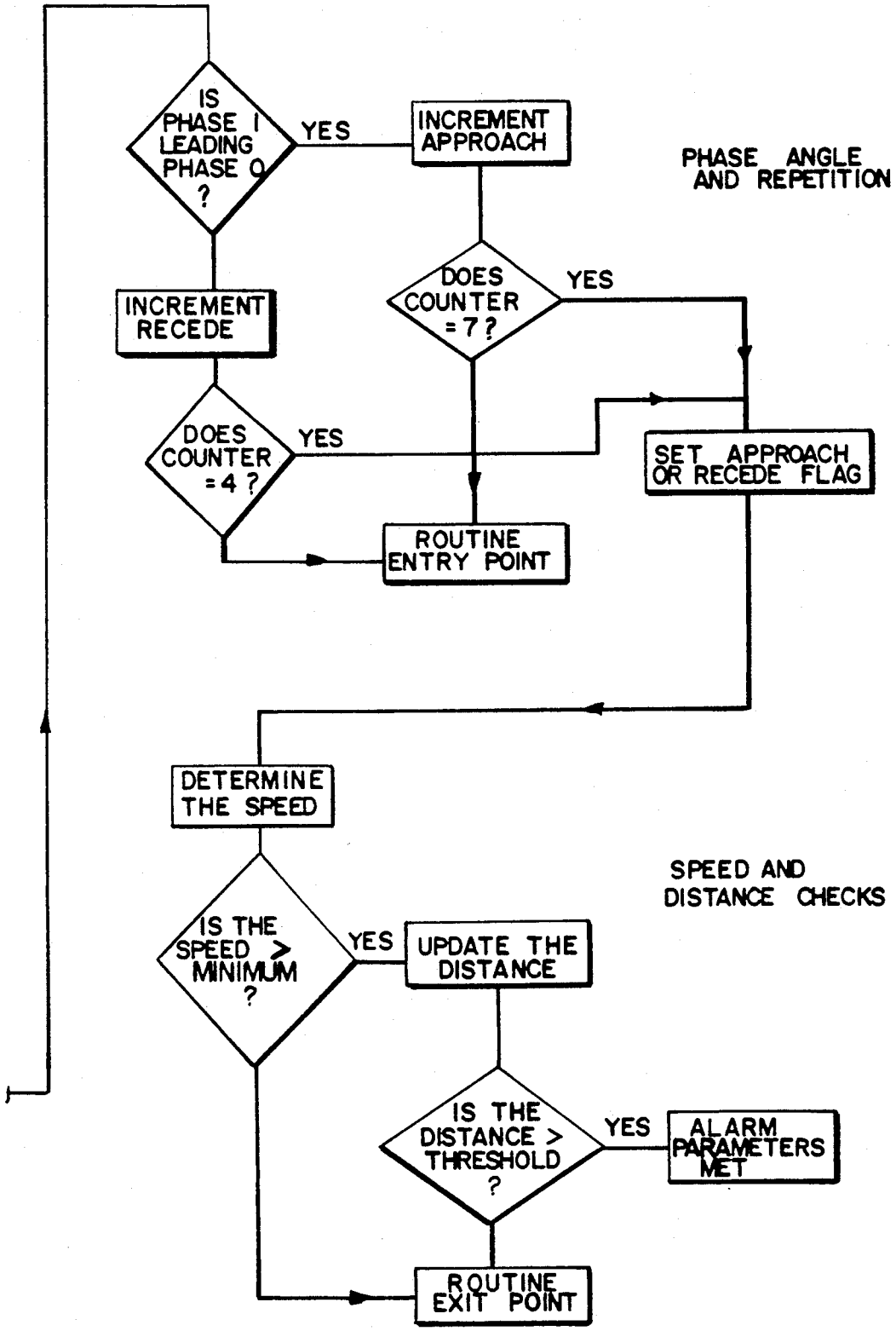
Figure 5:
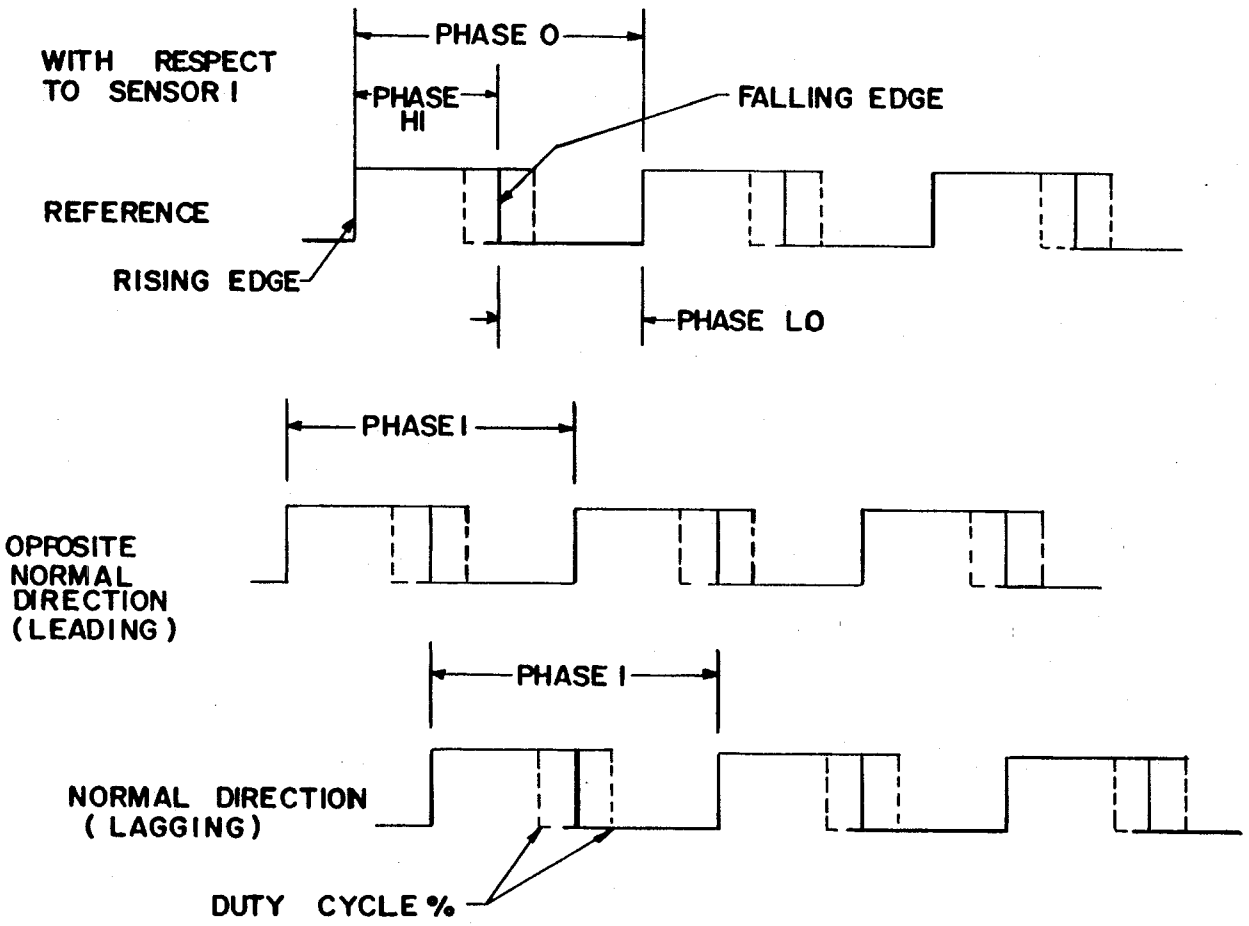
FIG. 5 is a wave form diagram which represents the manner in which signals commensurate with object direction and speed are derived by the apparatus of FIG. 2.

With reference now simultaneously to FIGS. 4 and 5, the step of processing the information bearing signals provided by the sensors, i.e., processing steps 74, 80, 96, 102 and 120, will be described. A number of factors are involved in determining whether or not the output signals from the sensing devices are valid. Samples of invalid signals are those indicative of background motion, i.e., trees, leaves, snow, fog, rain, etc., electrical noise, reflections resulting from the motion of animals or other objects moving at an angle with respect to the normal travel direction, etc. Ideally, the outputs from each of the sensors is a pair of square waves of equal frequency and with a 50% duty cycle. Also, ideally, one of these square wave signals is leading or lagging the other by 90°. In actual practice, the frequencies of the two square waves can be slightly different, the duty cycle can be something other than 50% and the phase shift can be slightly less or greater than 90°. Accordingly, a software routine is employed to verify duty cycle and matching frequencies, to compare phase, and to compute minimum speed, distance traveled and repetitions.

Referring to FIGS. 4-1 and 4-2 a software timer is started upon detection of a rising edge on the Phase 0 input. The time value PHASE 0 HI TIME is saved upon detection of the first falling edge and the timer is reset. The time until a rising edge is detected is then measured. This timer value, i.e., PHASE 0 LO TIME, is also saved. The sum of these two values, i.e., PHASE 0 HI TIME and PHASE 0 LO TIME, is the Phase 0 time period. A duty cycle window is checked by comparing the PHASE 0 HI TIME plus 25% to the PHASE 0 LO TIME and by comparing the PHASE 0 HI TIME −25% to the PHASE 0 LO TIME. It is to be noted that 25% of the PHASE 0 LO time is ideally 12.5% of the Phase 0 time period.

If the duty cycle is within the duty cycle window, the time period of the Phase 1 signal is determined, in the manner described above with respect to the duty cycle check, and the Phase 1 time is compared to the Phase 0 time +25% and to the Phase 0 time −25%. If the Phase 1 time is within the frequency window, i.e., if the Phase 1 time equals the Phase 0 time +/−25%, a frequency check is satisfied.

If the frequencies of the Phase 0 and Phase 1 signals are within range, the phase angle of the Phase 1 signal with respect to the Phase 0 signal is determined. This phase angle comparison is performed by first ascertaining whether the Phase 1 signal is leading the Phase 0 signal. This is accomplished by sensing the level of the Phase 1 signal when the rising edge of a Phase 0 signal occurs. If the Phase 1 signal is high when the leading edge of the Phase 0 signal occurs, the Phase 1 signal is the leading Phase 0 signal and this is indicative of an "approach", i.e., travel in a direction opposite to normal. Conversely, if the Phase 1 signal is low when the leading edge of the Phase 0 signal occurs, the Phase 1 signal is lagging the Phase 0 signal and the direction of motion is normal (recede). The possible phase relationships between the sensor Phase and Phase 1 signals may be seen from FIG. 5.

If the phase comparison is indicative of motion opposite to the normal direction, i.e., an "approach", an approach counter is incremented. If the sensor Phase 1 signal is lagging the sensor Phase 0 Signal, a recede counter is incremented. The numbers in the approach and recede counters are compared to predetermined limits, the recede counter limit being less than the approach counter limit, and the process continues until one of the counters is incremented to its limit or the routine is exited because either the duty cycle or frequency falls outside of its accepted range or one of the reset conditions described in the discussion of FIG. 3 occurs.

When either of the approach or recede counters reaches its limit, a corresponding flag will be set and the speed of the object will be determined. Speed is determined, in the manner to be briefly discussed below, by measuring frequency. As discussed above, the speed information is employed in step 86 of FIG. 3 and may be employed at the base station to determine whether the speed of the object is increasing or decreasing. The speed information is also used to determine approximately how far the object has traveled since it was first detected. The speed must exceed a preset minimum or the object is deemed invalid. If the speed is above the preset minimum, the approximate distance traveled is determined by scaling speed information to feet/second. Since the sensor cycle time is approximately one second, the scaled speed information is multiplied by time to determine the distance traveled in feet. Considering sensor 41, the distance traveled is positive if the approach flag was set and is negative if the recede flag was set. The distance information is accumulated until it reaches a preset threshold. If the approach distance threshold is exceeded, the appropriate detection parameters are deemed to have been established, i.e., the alarm parameters are met and a signal commensurate with a "yes" will result from the data processing step. If the duty cycle is not within range, or the Phase 1 frequency is not within range of the Phase 0 frequency, or the accumulation of approach distance traveled does not exceed the threshold or the speed of the object is not within range, the data processing step outputs a "no".

It is to be noted that the recede counter is implemented to guard against warning device energization in response to oscillatory motion in the field of the sensor, a swaying tree for example. It is also to be noted that each exit of the routine of FIG. 4, i.e., each sensor deactivation which is to be followed by a resumption of normal sensor cycling, is delayed by the software. As mentioned above in the discussion of FIG. 3, the sensing of a moving object will automatically increase the sensor off time.

In one reduction to practice of the present invention, the speed parameter was an approximate value used to determine whether a detected object was accelerating or decelerating in increments of 5 miles per hour. Speed was calculated by counting valid Phase 0 rising edges for a 62 ms time period. The period of the Phase 0 signal decreases as speed increases. At the end of the 62 ms time period, the number in the counter was equal to approximately two times the speed in miles per hour. Thus, the counter value divided by two was approximately equal to miles per hour. One and one half of this value is approximately equal to feet traveled per second. By comparing the successively calculated values commensurate with feet traveled per second, the increasing speed or decreasing speed parameter may be updated. As noted above, the feet per second value is used to update the distance parameter.

Figure 6:
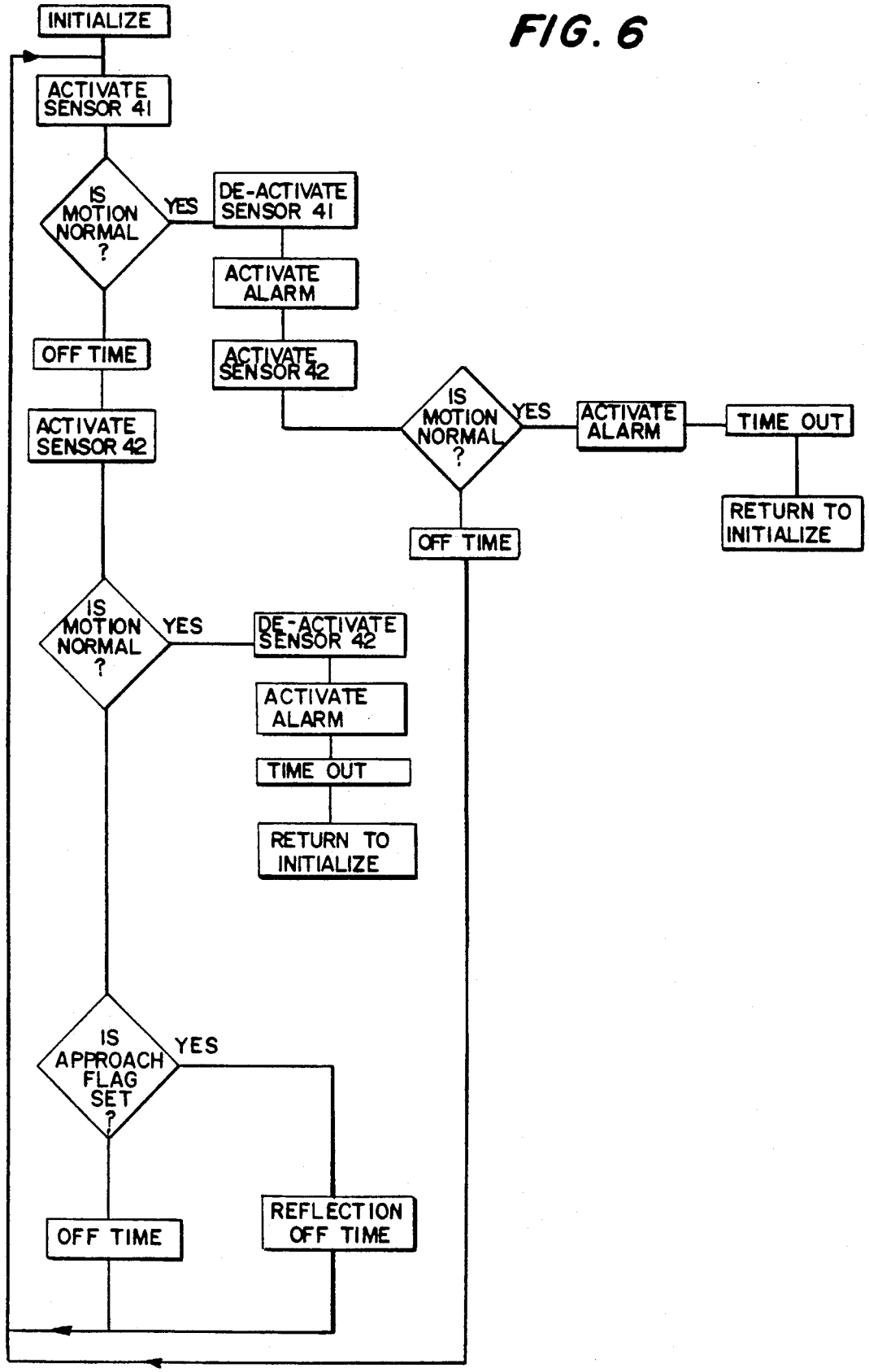
FIG. 6 is a flow chart, similar to FIG. 3, which explains the operation of an embodiment of the invention which employs a pair of motion detectors.

Referring now to FIG. 6, an embodiment of the invention which employs only a pair of motion detectors, i.e., a system which utilizes only module 10 of FIG. 1, is represented by an information flow diagram. It will be understood that the explanation of FIGS. 4 and 5, as set forth above, is applicable to the FIG. 6 embodiment. The FIG. 6 embodiment may, for example, be employed to warn a driver that his speed is excessive for a work zone, to warn a driver that he is exceeding a recommended speed limit or to cause activation of a warning device only when a vehicle is present in a particular area or zone. Other applications will become obvious to those skilled in the art. In the typical two sensor embodiment, as represented in FIG. 6, the object motion of interest is in the "normal" direction, i.e., a vehicle approaching sensor 41 is moving in the authorized or proper direction in a first traffic lane. A vehicle approaching sensor 42, presumably in a second traffic lane which is adjacent to the first lane, is also moving in an authorized direction. For purposes of implementing the invention, movement toward sensor 42 is "not" normal motion.

In the manner described above, the motion related signals provided by sensor 41 are processed to unambiguously determine whether a vehicle is approaching sensor 41 and, if so, whether the FIG. 4 conditions have been met. If the FIG. 4 conditions have been met, sensor 41 is deactivated, an alarm condition signal generated and sensor 42 activated. The setting of the alarm condition may cause a visual alarm, i.e., a "slow down" or "hazard ahead" signal, to be energized. The signals provided by sensor 42 will then be analyzed and, if the direction of vehicle motion is receding from sensor 42 and the alarm conditions are met, the energized state of the alarm will be continued, the system will time out and the cycle will start again.

If a moving vehicle is not in the field of sensor 41, or if processing of signals commensurate with any object motion within the field of view of sensor 41 indicates t hat a detected object is not approaching sensor 41, sensor 42 will be activated. Restated, sensors 41 and 42 are normally "on" and are activated in alternate fashion. Any signals provided by sensor 42 commensurate with the motion of an object in its field of view will be processed in the manner represented in FIG. 4. If this signal processing indicates that a vehicle satisfying the alarm conditions is moving away from sensor 42, an alarm condition signal will be produced as mentioned above. If the signal processing reveals that the moving object is approaching sensor 42, an approach flag will be set and the off time of the system adjusted in the manner described above.

The employment of two sensors which "look" in opposite directions results in a system which remains operative even if one sensor is disabled or "blocked".

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method for the classification of object motion comprising the steps of:

providing, at a measuring location along a path, a pair of phase-related cyclic signals commensurate with the motion of an object along the path, said signals having a known phase relationship when the object is stationary;

comparing the phase of said phase-related signals to determine if there is a difference in phase therebetween which is greater or less than the phase relationship commensurate with a stationary object, any such variation in phase difference from said known phase relationship being indicative of whether the moving object is moving generally toward or away form the measuring location, and incrementing a first counter if the phase comparison indicates object motion having a first directional component which includes motion toward or away from the measuring location;

incrementing a second counter if said phase comparison indicates object motion having a second directional component which is opposite to said first directional component;

comparing the number in the first counter with a first preselected number;

comparing the number in the second counter with a second preselected number which differs from said first preselected number;

determining whether the distance traveled by the object in a predetermined period of time exceeds a preselected minimum distance when the number in said second counter equals said second preselected number prior to the number in said first counter equalling said first preselected number;

and generating an alarm condition signal when the distance traveled by the moving object has executed said predetermined minimum distance.

2. The method of claim 1 wherein the step of providing a pair of phase-related cyclic signals comprises:

energizing a radiant energy signal generator to cause the emission of radiant energy at a known frequency;

receiving, at a pair of spacially displaced points at said measuring location, the emitted radiant energy which is reflected from the object, the spacial difference between the receiving points being commensurate with a known phase relationship for energy reflected from a stationary object; and transducing the reflected energy received at said pair of points into said pair of phase-related signals.

3. The method of claim 1 further comprising:

determining the frequency of at least one of said phase-related signals when the number in either said first or said second counter respectively equals said first or second preselected number, the frequency being commensurate with a speed of the object; and determining whether the speed of the object exceeds a preselected minimum speed, the distance traveled by the object being determined from the object speed if the object speed exceeds the preselected minimum speed.

4. The method of claim 1 further comprising the step of:

comparing the tie of succeeding half cycles of at least one of said phase-related signals to determine if the said one signal has a duty cycle which is within a preselected range, the generation of said alarm condition signal being enabled only if the duty cycle is within the preselected range.

5. The method of claim 1 further comprising the step of:

comparing the frequency of said phase-related signals, the generation of said alarm condition signal being enabled only if any difference in frequency is less than a preselected magnitude.

6. The method of claim 5 further comprising the step of:

comparing the time of succeeding half cycles of at least one of said phase-related signals to determine if the signal has a duty cycle which is within a preselected range, the generation of said alarm condition signal being enabled only if the duty cycle is within the preselected range.

7. The method of claim 2 further comprising the step of:

comparing the time of succeeding half cycles of at least one of said phase-related signals to determine if the signal has a duty cycle which is within a preselected range, the generation of said alarm condition signal being enabled only if the duty cycle is within the preselected range.

8. The method of claim 2 further comprising the step of:

comparing the frequency of said phase-related signals, the generation of said alarm condition signal being enabled only if any difference in frequency is less than a preselected magnitude.

9. The method of claim 7 further comprising the step of:

comparing the frequency of said phase-related signals, the generation of said alarm condition signal being enabled only if any difference in frequency is less than a preselected magnitude.

10. The method of claim 3 further comprising the step of:

comparing the time of succeeding half cycles of at least one of said phase-related signals to determine if the signal has a duty cycle which is within a preselected range, the generation of said alarm condition signal being enabled only if the duty cycle is within the preselected range.

11. The method of claim 3 further comprising the step of:

comparing the frequency of said phase-related signals, the generation of said alarm condition signal being enabled only if any difference in frequency is less than a preselected magnitude.

12. The method of claim 10 further comprising the step of:

comparing the frequency of said phase-related signals, the generation of said alarm condition signal being enabled only if any difference in frequency is less than a preselected magnitude.

13. A method for the detection and quantification of object motion along a path in a first of two generally opposite directions of travel comprising ht steps of:

monitoring, with a first motion detector, a first region which includes a portion of the path and generating first object motion signals commensurate with the motion of an object in said first monitored region;

determining the direction of the object motion in said first region and the distance traveled by the object in a first predetermined period of time form said first object motion signals;

monitoring, with a second motion detector, a second region which includes a portion of th path and generating second object motion signals commensurate with the motion of an object in said second monitored region;

determining the direction of object motion in said second region and the distance traveled by the object in a second predetermined period of time from said second object motion signals; and generating a first alarm condition signal when it is determined that an object is moving in a first direction in either said first or said second region and the distance travelled by the object in either of said first or second monitored regions respectively in said first or second predetermined periods of time exceeds a predetermined minimum distance.

14. The method of claim 13 wherein said motion detectors are caused to generate beam of radiant energy which are directed in the two generally opposite directions.

15. The method of claim 14 wherein said motion detector generated beams of radiant energy are normally alternately generated.

16. The method of claim 13 further comprising:

energizing the second motion detector to detect motion of an object int eh second region along the path in response to the detection of motion of the object in said first region;

comparing the direction information commensurate with object motion in said first and second regions;

activating a third motion detector if said comparison of motion direction information indicates object motion in opposite directions in said first and second regions, the third motion detector monitoring a third region along the path and generating third object motion signals commensurate with the motion of an object in said third region;

determining the direction of object motion in said third region form said third object motion signals provided by the third motion detector;

activating a fourth motion detector if the information commensurate with motion direction in any two of said first, second and third regions is indicative of object motion in said first direction, the fourth motion detector monitoring a fourth region along the path and generating fourth object motion signals;

determining the direction of motion of the object in said fourth region from said fourth object motion signals provided by the fourth motion detector and generating a second alarm condition signal if object motion in said first direction is determined in said fourth region.

17. The method of claim 16 wherein the motion detectors generate and transmit beams of radiant energy and receive a portion of said energy reflected from an object and wherein the second motion detector is activated if the information determined from said first object motion signals is indicative of motion either in said first direction or in a second direction opposite to said first direction.

18. The method of claim 17 further comprising the step of:

energizing an alarm device in response to said first alarm condition signal if the information derived from the output signals of either of the first or second detectors is indicative of object motion in said first direction.

19. Apparatus for the classification of object motion comprising:

motion detector means for providing a pair of phase-related cyclic output signals commensurate with the motion of an object along a generally linear path, said signals having a known phase relationship when the object is stationary;

first comparator means for comparing the phase of said phase-related signals, said first comparator means providing output signals commensurate with any difference in phase between said phase-related signals which is greater or less than said known phase relationship commensurate with a stationary object, any such phase difference from said known phase relationship being indicative of the direction of motion of a moving object, only one of said directions of motion of the object along the path being a normal direction of motion, said first comparator means comprising:

computer means, said computer means:

comparing the phase of said motion detector means provided signals to determine the direction of variation in the phase difference therebetween with respect to said known phase relationship;

incrementing a first computer if the phase comparison indicates object motion in the normal direction;

incrementing a second counter if the phase comparison indicates object motion in a direction opposite to the normal direction;

comparing the instantaneous count in the first counter with a first preselected number;

comparing the instantaneous count in the second counter with a second preselected number, the second number having an absolute value which is greater than that of said first number; and providing a motion direction indication output signal when one of said counters is incremented by a number of counts equal to its associated preselected number;

means responsive to the signals provided by said motion detector means and the motion direction indication output signal provided by said computer means for providing signals commensurate with the speed of the object;

second comparator means responsive to said signals commensurate with the speed of the object for generating an alarm arming signal when the object speed exceeds a predetermined minimum speed;

means responsive to said signals commensurate with object speed and said arming signal for generating signals commensurate with the distance traveled by the object; and third comparator means responsive to said signals commensurate with object travel distance for generating an alarm condition signal when the distance traveled by the object exceeds a predetermined minimum distance.

20. The apparatus of claim 19 wherein said second and third comparator means and said means for providing signals commensurate with speed and distance traveled also comprise said computer means, said computer means further determining the frequency of at least one of said motion detector means signals, the speed of the object being determined from the frequency.

21. Apparatus for discriminating between the motion of objects in two generally opposite directions along a path, only a first one of said directions being a normal motion direction, said apparatus comprising:

first motion detector means for monitoring a first region along a portion of the path and generating first object motion signals commensurate with the motion of an object located in said first monitored region, said first motion detector means periodically generating a beam of radiant energy which is transmitted into said first region;

means responsive to said first object motion signals for generating first signals indicative of which of the two directions said object located in said first region is moving, and determining the distance travelled by the object in the first region in a first predetermined period of time;

second motion detector means for monitoring a second region which includes a second portion of the path, said second motion detector means generating second object motion signals commensurate with the motion of an object located in said second region, said second motion detector means generating a beam of radiant energy which is transmitted into said second region in a direction generally opposite to the direction of transmission of the beam of radiant energy of said first detector means;

means responsive to said second object motion signals for generating second signals indicative of which of the two directions a said object located in said second region is moving, and determining the distance travelled by the object in the second region in a second predetermined period of time;

and means responsive to said first and second signals indicative of direction of motion for generating a first alarm condition signal when an object is moving in a preselected one of said directions in either of said first or second regions and when the distance travelled by the object in either of said first or second monitored regions respectively exceeds a predetermined minimum distance in said first or second predetermined periods of time.

22. The apparatus of claim 21 wherein said preselected one of said directions is an abnormal direction and said first and second motion detector means generate signals commensurate with motion of the same object, said apparatus further comprising:

means for comparing said first and second signals indicative of direction and for generating output signals indicative of the results of said comparison;

third motion detector means, said third motion detector means monitoring a third region along a portion of the path and generating third object motion signals commensurate with the motion of said object in said third region;

means responsive to a said output signal generated by said means for comparing for activating said third motion detector means if said first and second signals indicative of direction of object motion do not agree;

means responsive to said signals commensurate with object motion provided by said third detector means for generating third signals indicative of which of the two directions said object is moving; and means responsive to said first, second and third signals indicative of direction for generating an alert signal if any two of said signals indicate object motion in said abnormal direction along the path.

23. The apparatus of claim 21 further comprising:

fourth motion detector means, said fourth motion detector means monitoring a fourth region along the path and generating fourth object motion signals commensurate with motion of said object in said fourth region;

means responsive to said alert signal for energizing said fourth motion detector means;

means responsive to said fourth object motion signals generated by said fourth motion detector means for providing fourth signals indicative of which of the two directions the object is moving; and means responsive to said fourth signals indicative of direction for generating a second alarm signal condition if the direction of object motion indicated thereby is in said abnormal direction.

24. The apparatus of claim 23 further comprising:

at least a first warning device; and means for energizing said warning device when any of said first, second or fourth signals indicative of motion direction is commensurate with motion in said abnormal direction.

25. The apparatus of claim 24 wherein said region monitored by said fourth motion detector means in part encompasses a region which is downstream of said warning device in said abnormal direction.

* * * * *

UNITED STATES PATENT AND TRADEMARK OFFICE

CERTIFICATE OF CORRECTION

PATENT NO. : 5,170,162
DATED : December 8, 1992
INVENTOR(S) : Thomas M. Fredericks It is certified that error appears in the above-indentified patent and that said Letters Patent is hereby corrected as shown below:

Column 4, line 2, "3" should read --34--.

Column 9, line 40, after "Phase" (first occurrence) insert --0--.

Column 11, line 52, "form" should read --from--.

Column 12, lines 5 and 6, "executed" should read --exceeded--; line 35, "tie" should read --time--.

Column 13, line 30, "ht" should read --the--; line 37, "form" should read --from--; line 40, "th" should read --the--; line 56, "beam" should read --beams--; line 64, "int eh" should read --in the--.

Column 14, line 9, "form" should read --from--; line 63, "computer" should read --counter--.

Column 16, line 59, "fourth" should read --third--.

Signed and Sealed this

Twenty-sixth Day of April, 1994

*Attest:*

Bruce Lehman

BRUCE LEHMAN

*Attesting Officer*

*Commissioner of Patents and Trademarks*